US011357691B2

(12) United States Patent
Lindemann

(10) Patent No.: US 11,357,691 B2
(45) Date of Patent: Jun. 14, 2022

(54) FINGER MOTION RAIL, SUPPORT THEREFOR AND THERAPY DEVICE COMPRISING SAME AND OPERATING METHOD

(71) Applicant: LIME MEDICAL GMBH, Mainz (DE)

(72) Inventor: Pascal Lindemann, Mainz (DE)

(73) Assignee: LIME medical GmbH, Mainz (DE)

( * ) Notice: Subject to any disclaimer, the term of this patent is extended or adjusted under 35 U.S.C. 154(b) by 740 days.

(21) Appl. No.: 15/998,574

(22) PCT Filed: Feb. 15, 2017

(86) PCT No.: PCT/DE2017/100116
§ 371 (c)(1),
(2) Date: Aug. 15, 2018

(87) PCT Pub. No.: WO2017/140302
PCT Pub. Date: Aug. 24, 2017

(65) Prior Publication Data

US 2019/0209412 A1 Jul. 11, 2019

(30) Foreign Application Priority Data

Feb. 15, 2016 (DE) ..... 202016000943.6
Feb. 15, 2016 (DE) ..... 202016000944.4

(51) Int. Cl.
*A61H 1/02* (2006.01)

(52) U.S. Cl.
CPC ..... *A61H 1/0288* (2013.01); *A61H 2201/123* (2013.01); *A61H 2201/149* (2013.01);
(Continued)

(58) Field of Classification Search
CPC ..... A61H 1/0285; A61H 1/0288; A61H 2205/067; A61F 2005/0132–0179; B25J 9/0006
See application file for complete search history.

(56) References Cited

U.S. PATENT DOCUMENTS 3,631,542 A * 1/1972 Potter ..... A61F 2/72 623/25
5,103,807 A * 4/1992 Makaran ..... A61H 1/0288 601/40
(Continued)

FOREIGN PATENT DOCUMENTS

EP 1262159 A2 12/2002
EP 2549971 B1 12/2014
(Continued)

OTHER PUBLICATIONS

Itakashi Watsuki, "Mounting type motion support device", JP02011115248A, publication date Jun. 16, 2011, this translation was obtain on Oct. 29, 2020 (Year: 2011).*

*Primary Examiner* — Michael J Tsai
(74) *Attorney, Agent, or Firm* — Laurence A. Greenberg; Werner H. Stemer; Ralph E. Locher

(57) ABSTRACT

A finger motion rail is provided for a therapy device for carrying out passive and/or actively-assisted motion of the fingers and thumb of the hand. The therapy device has an upper shell, to which a kinematic motion mechanism of the finger motion rail for each selected finger is connected, each mechanism has a motion drive that is in control engagement with a control system. The kinematic motion mechanism of the finger motion rail, which mechanism has a carriage that moves in a rail provided around the metacarpophalangeal joint and a pivoting lever, is located at the side of each finger for the passive and/or actively-assisted motion of the selected fingers. This allows an individual finger motion rail
(Continued)

with the kinematic motion mechanism to be provided for each selected finger, the rail being located at the side of each finger, thus permitting each selected finger to bend and/or stretch without constraint.

16 Claims, 6 Drawing Sheets

(52) U.S. Cl.
CPC ..... *A61H 2201/1481* (2013.01); *A61H 2201/165* (2013.01); *A61H 2201/1635* (2013.01); *A61H 2201/1638* (2013.01); *A61H 2201/1676* (2013.01); *A61H 2201/5061* (2013.01)

(56) References Cited

U.S. PATENT DOCUMENTS 5,178,137 A * 1/1993 Goor ..... A61F 5/0111 601/40
5,697,892 A * 12/1997 Torgerson ..... A61H 1/0288 601/40
5,912,658 A * 6/1999 Bergamasco ..... B25J 13/02 345/156
9,375,382 B2 * 6/2016 Fausti ..... A63B 23/16
9,532,916 B2 * 1/2017 Tsui ..... A61H 1/0288
9,820,908 B2 * 11/2017 Elia ..... A63B 21/4021
2010/0305717 A1 * 12/2010 Tong ..... A63B 21/4019 623/64
2013/0261514 A1 * 10/2013 Tsui ..... A61H 1/0285 601/40
2014/0288664 A1 * 9/2014 Miyazawa ..... A61F 5/013 623/24
2015/0223959 A1 * 8/2015 Cempini ..... A61F 5/013 602/22
2015/0342818 A1 * 12/2015 Ikebe ..... A61H 1/0288 601/40
2017/0266075 A1 * 9/2017 Becchi ..... A63B 23/16
2018/0185231 A1 * 7/2018 Huang ..... A61H 1/0288

FOREIGN PATENT DOCUMENTS

JP 2002345861 A 12/2002
JP 2007313093 A 12/2007
JP 2011115248 A * 6/2011
JP 2011115248 A 6/2011

* cited by examiner

FINGER MOTION RAIL, SUPPORT THEREFOR AND THERAPY DEVICE COMPRISING SAME AND OPERATING METHOD

BACKGROUND OF THE INVENTION

Field of the Invention

The present invention relates to a finger motion rail for a therapy device for performing a sustained, passive and/or actively assisted motion of the fingers and thumb of the hand of a patient, wherein the device has an upper shell which preferably covers the forearm and the wrist and to which motion kinematics of a finger motion rail for each selected finger are connected, each motion kinematic having a motion drive that is in control connection to a control system.

The present invention also relates to a support for one or more such finger motion rails which perform a sustained, passive and/or actively assisted motion of selected fingers of the hand of a patient, wherein the support has an upper shell which covers the forearm and/or the wrist and to which finger motion rails for each selected finger are connected, which finger motion rails are each in control connection to a control system.

The present invention moreover relates to a therapy device for performing a sustained, passive and/or actively assisted motion of the fingers and thumb of the hand of a patient, and also to an operating method therefore.

Such therapy devices have already been disclosed in various designs as a wrist motion rail or as a finger motion rail. They are used, for example, for sustained passive and/or actively assisted joint mobilization after operations in the hand region.

As an example of a finger motion rail, EP 1 262 159 A2 discloses a therapy device with which flexion and extension movements of the fingers can be performed and which has a support for a motion drive which is arranged on the back of the hand and on which pivoting levers are mounted on one side or on both sides. At the end remote from the drive, these pivoting levers are attached to a transverse bracket which, on the outer aspect of the hand, is positioned at a distance from or on or under the fingers. Finger-securing elements of different designs can be mounted on the transverse bracket in order to permit adaptation to the different finger lengths.

Although such supports are already known in various designs for finger motion rails, only one finger motion rail is mounted on each of them which can perform the motion exercise with several fingers simultaneously. Finger motion rails of this kind and their supports have the disadvantage that they are not very precisely adapted to the anatomical structure of the individual fingers and are thus limited in terms of their range of treatment.

U.S. Pat. No. 5,697,892 A1 discloses a further device for sustained passive motion of the hand, with which flexion and extension movements of the fingers can be performed. A disadvantage of this device is firstly that the finger movement is limited by a mechanical motion kinematic bearing on the fingers. In addition, the fingers cannot be treated individually and independently of each other.

To avoid this, EP 2 549 971 B1 has disclosed a hand rehabilitation device which is distinguished by flexible rods for a passive and actively assisted simultaneous and/or selective flexion/extension of the five fingers according to a complete flexion movement or gripping of objects and/or simulation of everyday activities with exercises, sequences and/or combinations of movements freely settable by the user, elements for the sliding and supporting of the flexible rods during the flexion/extension of the fingers.

SUMMARY OF THE INVENTION

In relation to the prior art, the object of the present invention is firstly to make available an improved finger motion rail for a therapy device for performing a sustained, passive and/or actively assisted motion of the fingers and thumb of the hand of a patient, wherein the device has an upper shell to which motion kinematics of a finger motion rail for each selected finger are connected, each motion kinematic having a motion drive that is in control connection to a control system, in particular without the movement of the finger being impeded by mechanical parts bearing on the finger.

In relation to the prior art, the object of the present invention is also to make available an improved support for one or more such finger motion rails which are able to perform motion exercises on only one finger each.

In relation to the prior art, the object of the present invention is additionally to make available an improved therapy device and operating method, which therapy device has, for each finger, a dedicated individual finger motion rail with motion kinematics. In this way, the movements are individually adaptable to each finger, which increases the chances of success of a treatment.

The object of the present invention is finally to make available a method for operating a therapy device for an intended passive and/or actively assisted flexion movement of the fingers.

These objects are achieved, in terms of a finger motion rail, by the features of the main finger motion rail claim; in terms of a support for one or more such finger motion rails, by the features of the main support claim; in terms of a therapy device for performing a sustained, passive and/or actively assisted motion of the fingers and thumb of the hand of a patient, by the features of the main therapy device claim; and in terms of the method for operating such a therapy device, by the features of the main method claim.

Advantageous embodiments and developments, which can each be implemented individually or in combination with one another, are the subject matter of the dependent claims.

A finger motion rail according to the invention builds on generic finger motion rails in that the motion kinematics of the finger motion rail, which have a carriage that moves in a rail arranged around the metacarpophalangeal joint and at least one pivoting lever, are arranged laterally alongside each finger for the passive and/or actively assisted motion of the selected fingers. This advantageously makes it possible to make available, for each selected finger, a dedicated finger motion rail with motion kinematics which, arranged laterally of the finger that is to be treated, also allows the respectively selected finger an unimpeded flexion and/or extension movement.

In a first embodiment of the finger motion rail, the motion kinematics preferably have at least a first pivoting lever for securing a distal phalanx, and a second pivoting lever, wherein the first pivoting lever is advantageously pivotably connected to the second pivoting lever, and wherein the second pivoting lever is advantageously pivotably connected to the carriage. This embodiment of the motion kinematics of a finger motion rail advantageously makes it possible to arrange two pivotably interconnected pivoting levers and a carriage, pivotably connected to the second pivoting lever, in a functional position laterally alongside the finger to be treated, with their pivot axes approximately in a continuation of the joint axes of the metacarpophalangeal joints, with the exception of the thumb the proximal interphalangeal joints and the distal interphalangeal joints. Such a pivotable connection of the pivoting levers and of the carriage advantageously permits a passive and/or actively assisted motion of the respective finger in the scope of motion exercises according to the natural flexion movement of the fingers.

In a further embodiment of the finger motion rail, it is preferable that the carriage moves on an orbit which is defined by the shape of the carriage and/or of the rail. It has proven expedient that the center point of the orbit on which the carriage moves around the metacarpophalangeal joint is approximately coincident with the anatomical joint axis of the metacarpophalangeal joint. The orbit on which the carriage moves about the metacarpophalangeal joint can result from the shape of the carriage and/or from the shape of the rail. The arrangement of motion kinematics laterally and directly alongside a metacarpophalangeal joint, as in the case of the proximal interphalangeal joint and the distal interphalangeal joint, is not possible insofar as the metacarpophalangeal joint of another finger is already located there. This portion of the motion kinematics must therefore be formed by the combination of rail and carriage and must extend on an orbit laterally with respect to the metacarpophalangeal joint.

Also preferred according to the invention is an embodiment of the finger motion rail in which each motion drive provides motorized driving of a carriage, preferably directly, and each motion drive provides motorized driving of at least one pivoting lever via at least one lever mechanism of the motion kinematics, preferably indirectly by connection to the carriage. The carriage, preferably motor-driven directly by means of the motion drive, the second pivoting lever, preferably driven indirectly, by connection to the carriage, and the first pivoting lever, likewise preferably driven indirectly, by connection to the second pivoting lever, can be in drive engagement for the intended flexion movement of the fingers in such a way that the carriage and the two pivoting levers can advantageously be actively pivoted in accordance with the natural flexion movement of the fingers.

In addition, an embodiment of the finger motion rail has proven expedient in which the lever mechanism has at least two joint connections which pivotably connect the lever mechanism to the carriage, the rail, the first pivoting lever, the second pivoting lever and/or a connection means. It is of advantage here if the arrangement of the joint connections is chosen in such a way that, during a movement of the carriage, a force transmission to the first pivoting lever, to the second pivoting lever and/or to the connection means takes place. In order to transmit the pivoting movement from the motion drive to the carriage, the motion drive is thus preferably connected to the carriage. The lever mechanism can advantageously permit the transmission of the pivoting movement from the motion drive to the two pivoting levers and is expediently accommodated within inside the outer contour of the pivoting levers. The lever mechanism and the pivoting levers can be adapted by their structure, in particular by the arrangement of the joint connections, to the force that is needed to move the finger. In this way, at a constant uptake of force from the motion drive, the motion kinematics of a finger motion rail can advantageously make available different forces for the motion therapy. A more or less extended finger requires little force in order to be flexed, whereas a considerably flexed finger requires much more force in order to be further flexed. The motion kinematics are adapted approximately to these differences. With a finger more or less extended, for example, a lower force is exerted on the finger than in the case of a more or less flexed finger.

According to a further embodiment of the finger motion rail, it is preferable if first releasable securing and/or bearing means for releasably securing and/or bearing a proximal phalanx of a finger to be treated are arranged on the carriage, and/or if second releasable securing and/or bearing means for releasably securing and/or bearing a distal phalanx of a finger to be treated are arranged on the first pivoting lever. In order to transmit the pivoting movement from the motion kinematics of a finger motion rail to the patient's finger that is to be treated, the first pivoting lever is therefore secured to the distal phalanx with a releasable second securing and/or bearing means, and the carriage is secured on the proximal phalanx with a releasable first securing and/or bearing means. The releasable securing and/or bearing means can be configured, for example, as a hook-and-loop tape enclosing the distal phalanx or proximal phalanx, as an elastic ring or as a preferably padded plate and can preferably be used universally for different sizes of the body part that is to be secured.

Finally, an embodiment of the finger motion rail has proven expedient in which at least one mechanical component of the motion kinematics and/or of the releasable securing and/or bearing means, preferably the first carriage and/or the releasable securing and/or bearing means, comprise a sensor for measuring the force acting on the respective finger and/or exerted by the respective finger on the finger motion rail. It is of advantage here if the sensor exchanges control data with the control system and/or with the motion drive.

The measurement of the force acting on the respective finger and/or exerted by the respective finger on the finger motion rail, and the exchange of these control data with the control system and/or with the motion drive, advantageously permits sustained performance of a planned actively assisted motion of the fingers and thumb of the hand of a patient. Therefore, in contrast to passive motion, which is not necessarily based on control data made available by a sensor, it is advantageously possible to achieve not only mobilization but also strengthening of the hand and/or of individual fingers of a patient.

A support according to the invention for one or more finger motion rails as described above builds on generic supports in the sense that the finger motion rails, which each consist of mechanical components that at least comprise motion kinematics for moving the finger and of a motion drive, are arranged adjustably and lockably on the upper shell for the passive and/or actively assisted motion of the respective finger. Since it is possible for a dedicated finger motion rail to be arranged adjustably and lockably on an upper shell for each finger, this rail can advantageously be adjusted in position and to the size of the finger that is to be treated. Therefore, a new upper shell does not have to be developed and produced for each patient, which brings a financial advantage.

On the upper shell, the one or more finger motion rails can in particular be adjusted and locked preferably parallel to an axis running from the elbow to the wrist. In this way, the support is advantageously adjustable to fingers of different length.

By their configuration on the upper shell, the one or more finger motion rails can moreover be adjusted on the upper shell perpendicular to an axis running from the elbow to the wrist. In this way, the upper shell is also advantageously adjustable to different widths of hands.

The adjustability of the individual finger motion rails can moreover be permitted in different ways. For example, securing of the one or more finger motion rails on the upper shell would be possible using hook-and-loop fasteners and/or magnets, wherein the adjustment of the position of the finger motion rails on the upper shell results from the fact that the finger motion rails can be secured at different locations.

Moreover, adjustability and assembly of the one or more finger motion rails on the upper shell can be permitted by the fact that the finger motion rails are secured by a clamping holder, for example on rails which are mounted on the upper shell 10.

Therefore, in a first embodiment of the support, it is preferable if the one or more finger motion rails can each be fixed on the upper shell, by a releasable clamping holder, such that the one or more finger motion rails can be adjusted in terms of their position with respect to the upper shell when the clamping holder is opened. When the clamping holder is opened, the position of the finger motion rails can advantageously be adjusted, whereas the finger motion rails are preferably immovable when the clamping holder is closed.

In a further embodiment of the support, it is preferable if, on the basis of releasable securing means, the upper shell of the support is designed to be fixable on a hand rest or is designed to be fixable on the actual patient, wherein the upper shell of the support is designed to be fixable preferably on the basis of first releasable securing means on the hand of the patient and/or on the basis of second releasable securing means on the forearm of the patient. With releasable securing means, the upper shell thus permits stationary fixing on a hand rest or mobile fixing on the actual patient. The wrist is advantageously fixed by the upper shell, which prevents deflecting movements of the hand via the wrist and thus intensifies the treatment of the patient. However, a mobile fixing of the upper shell can likewise be effected only on the forearm or only on the hand.

Finally, an embodiment of the support is preferred in which the control system is designed to be mountable on the upper shell of the support. A control system mounted on the upper shell has the advantage of being in control connection to the motion kinematics of the various finger motion rails for the individual fingers, equally by wire connection or by radio connection.

A therapy device according to the invention for performing a sustained, passive and/or actively assisted motion of the fingers and thumb of the hand of a patient is characterized by a support for one or more finger motion rails as described above. Such a therapy device can sequentially and/or synchronously move and thus advantageously mobilize and/or strengthen an individual finger and/or a group of fingers of the hand.

Finally, a method for operating such a therapy device is characterized in that, for an intended passive and/or actively assisted flexion movement and/or extension movement of the fingers, the carriage, the second pivoting lever and the first pivoting lever are in drive engagement with the motion drive, such that the carriage and the two pivoting levers are actively pivoted in accordance with a natural flexion and/or extension movement of the fingers.

In the context of the present invention, the term "passive" denotes a flexion and/or extension motion of the fingers effected exclusively by the finger motion rail and without muscular force of the patient.

By contrast, in the context of the present invention, the term "actively assisted" denotes a flexion and/or extension motion of the fingers in which the patient has to at least partially apply muscular force, but wherein the finger motion rail:

a. provides assistance in the sense that the muscular force to be applied is less than in the case of a movement without finger motion rail; or
b. provides assistance in the sense of guiding the movement, wherein the patient has to apply the full muscular force; or
c. provides assistance in the sense that the patient has to work against a resistance generated by the finger motion rail and thus has to apply greater muscular force than in the case of a movement without finger motion rail.

The present invention makes available a finger motion rail, having dedicated motion kinematics for each selected finger, which is for the first time arranged laterally of the finger that is to be treated. A therapy device is thus created which is able to perform the movements in a manner adapted to each finger and thus more ergonomically and more effectively. Therefore, a great improvement is achieved over the prior art, in which the motion kinematics can still only be adapted inadequately to the different shapes of the fingers.

Additional embodiments of the invention, along with their essential details, are explained more specifically hereinbelow with reference to the drawings.

DESCRIPTION OF THE INVENTION

In the following description of preferred embodiments of the present invention, identical reference signs designate identical or comparable components.

Figure 1A:
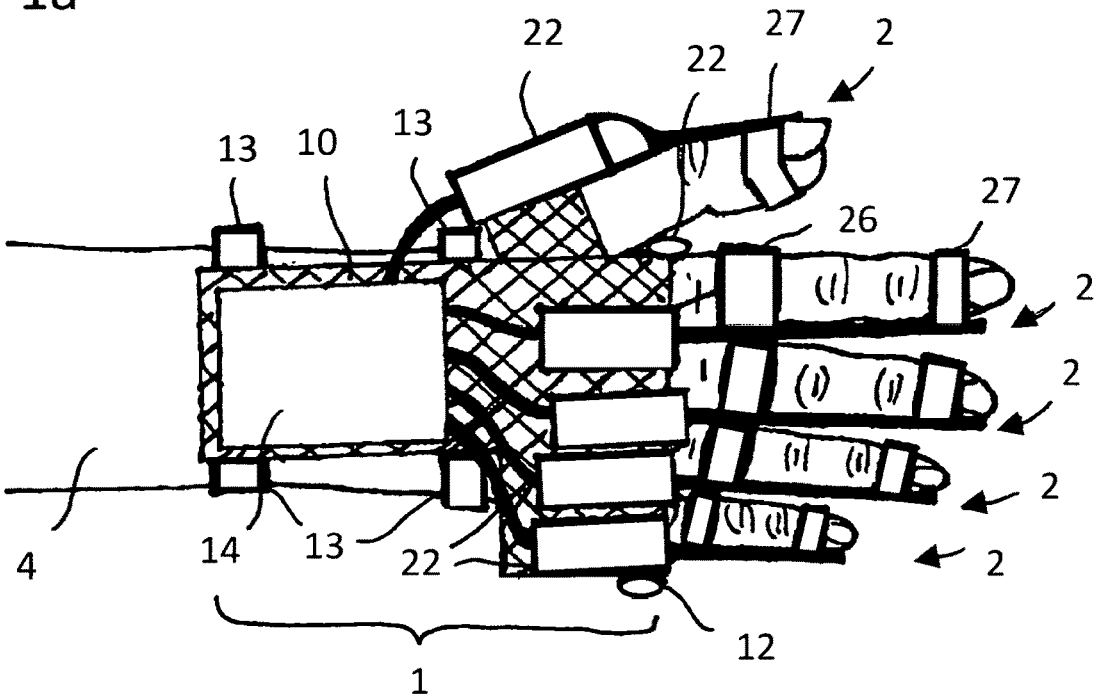
FIG. 1*a* shows a plan view of a support with finger motion rails according to the invention for all five fingers of a hand, with a wired control connection between a control system and motion drives.
Figure 1B:
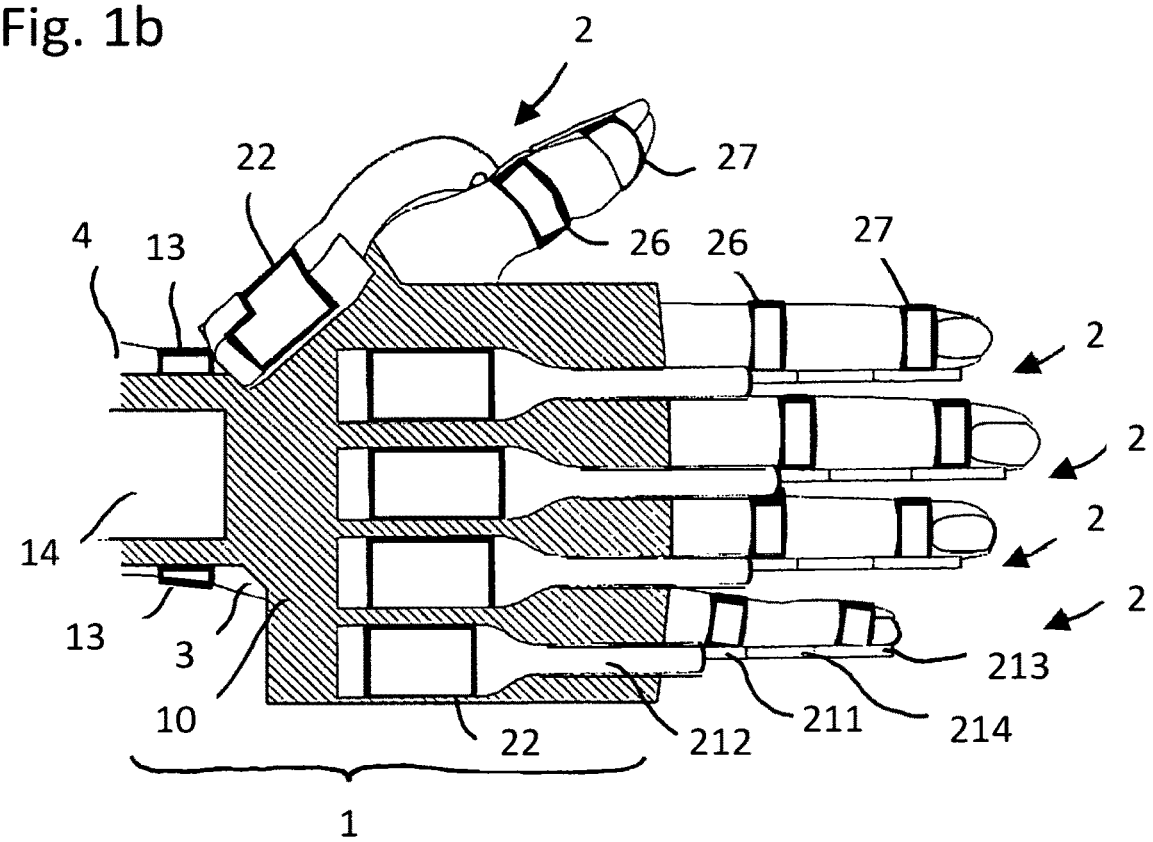
FIG. 1*b* shows the support and finger motion rail from FIG. 1*a*, wherein the control connection between control system and motion drives is wireless.

FIG. 1*a* and FIG. 1*b* each show a plan view of a support 1 with finger motion rails 2 according to the invention for all five fingers of a hand 3 and with a wired (FIG. 1*a*) and wireless (FIG. 1*b*) control connection between a control system 14 and motion drives 22.

The therapy device shown serves to perform a sustained, passive and/or actively assisted motion of selected fingers of a hand 3. By way of the motion kinematics 21 of a finger motion rail 2, movement exercises can be performed on the respective finger that is to be moved, wherein the finger is flexed at the metacarpophalangeal joint 31, at the proximal interphalangeal joint 32 and at the distal interphalangeal joint 33.

The therapy device moreover has a support 1 for one or, as shown here, several finger motion rails 2, and also an upper shell 10 which can be placed on the outer aspect of the forearm 4 and covers the wrist 30. As shown here, the upper shell 10 can be fixed by releasable securing means 12 and 13 advantageously to the forearm 4 and to the hand 3 of a patient. The wrist 30 of the patient is fixed by the upper shell 10, which prevents deflecting movements of the hand 3 via the wrist 30 and thus intensifies the treatment of the patient. However, a mobile fixing of the upper shell 10 can likewise be effected only on the forearm 4 or only on the hand 3. A temporary stationary fixing is also conceivable, for example on a hand rest to which the upper shell 10 can be fixed (not shown).

On the upper shell 10, finger motion rails 2 can in particular be adjusted and locked parallel to an axis running from the elbow to the wrist 30. In this way, the support 1 is advantageously individually adjustable to fingers of different length of a patient or from patient to patient. By their configuration on the upper shell 10, the finger motion rails 2 can moreover be adjusted on the upper shell 10 perpendicular to an axis running from the elbow to the wrist 30. In this way, the support 1, in particular the upper shell 10, can be adjusted individually to different widths of hands 3 or a patient or from patient to patient (see also FIG. 7 and FIG. 8 for an explanation of this).

The advantageously individual adjustability of the individual finger motion rails 2 can be permitted in different ways. Securing of the finger motion rails 2 on the upper shell 10 can be effected in particular by hook-and-loop fasteners or magnets, wherein the adjustment of the position of the finger motion rails 2 on the upper shell 10 results from the fact that the finger motion rails 2 can be secured to the upper shell 10 at different locations.

In addition, in a further embodiment, adjustability and assembly of the finger motion rails 2 on the upper shell 10 can be permitted by the fact that the finger motion rails 2 are secured by a clamping holder 11 on rails 111 which are mounted on the upper shell 10. When the clamping holder 11 is opened, the position of the finger motion rails 2 can be adjusted, whereas the finger motion rails 2 are preferably immovable when the clamping holder 11 is closed (cf. also FIG. 8).

A control system 14, which preferably comprises control electronics, can be arranged on the upper shell 10 and is in control connection to the various finger motion rails 2, in particular with the motion drives 22 thereof, for the individual fingers. This control connection can be provided by wires, as can be seen in FIG. 1*a*, but it can also be wireless, in particular via Bluetooth or another wireless data transmission method (FIG. 1*b*).

Figure 2A:
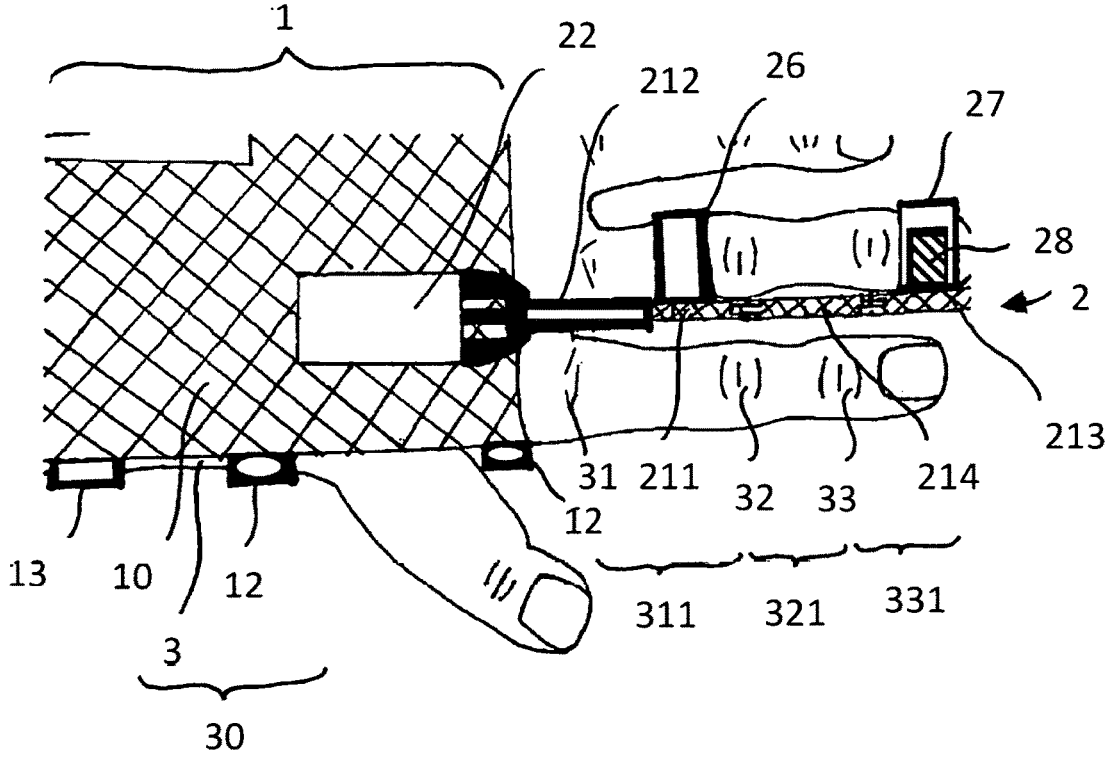
FIG. 2*a* shows a plan view of an individual finger motion rail from FIGS. 1*a* and 1*b*, arranged on the upper shell of a support and secured to the finger of a hand.
Figure 2B:
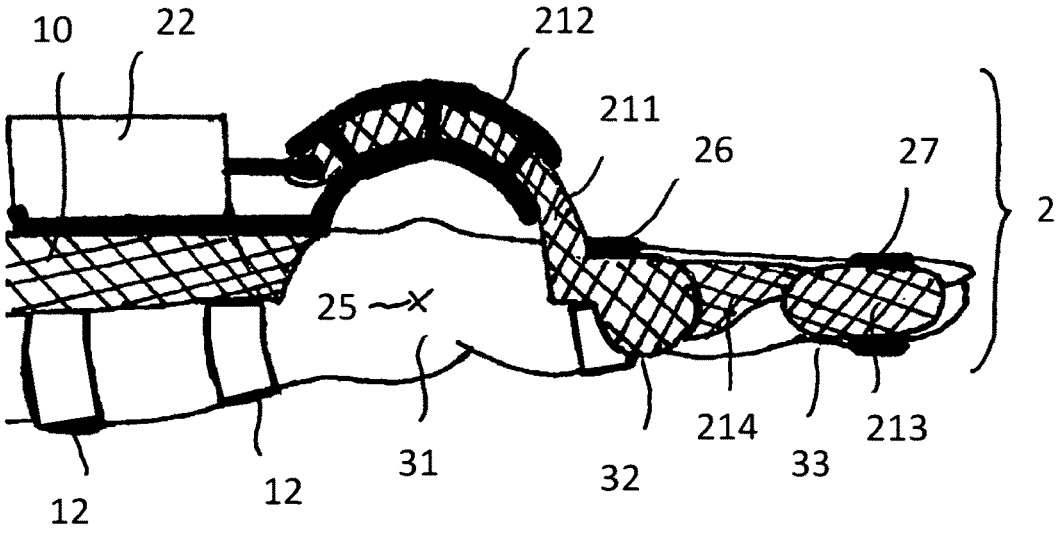
FIG. 2*b* shows a side view of the finger motion rail from FIG. 2*a* secured to the finger of a hand.

FIG. 2*a* and FIG. 2*b* show a plan view (FIG. 2*a*) and a side view (FIG. 2*b*) of an individual finger motion rail 2 from FIGS. 1*a* and 1*b* which is arranged on the upper shell 10 of a support 1 and which is secured to the finger of a hand 3.

It will be seen that the two pivoting levers 213; 214, connected pivotably to each other, and the carriage 211, connected to the second pivoting lever 214 and running in a rail 212, are advantageously arranged for the flexion movements of the fingers in a functional position laterally alongside the finger that is to be treated. The first pivot axis 23 between the first pivoting lever 213 and the second pivoting lever 214 preferably coincide approximately with the anatomical joint axis of the distal interphalangeal joint 33 or can be brought into coincidence with each other by the individual adjustability and lockability; similarly, the second pivot axis 24 between the second pivoting lever 214 and the carriage 211 is preferably approximately coincident with the anatomical joint axis of the proximal interphalangeal joint 32 or can be brought into coincidence with each other by the individual adjustability and lockability. The carriage 211 can advantageously move on an orbit whose center point 25 is approximately coincident with the anatomical joint axis of the distal interphalangeal joint 33 or can be brought into coincidence with each other by the individual adjustability ad lockability. The rail 212 is arranged pivotably and lockably on the upper shell 10, as a result of which the positions of the motion kinematics 21 can be adapted to the individual shapes of the hands 3. By virtue of this arrangement, a large part of the force transmitted to the finger can be used for performing the motion exercises. Forces acting otherwise are taken up by the finger and do not contribute to improving the state of the patient or can even lead to a deterioration of the state.

The orbit on which the carriage 211 moves about the metacarpophalangeal joint 31 can result from the shape of the carriage 211 and/or from the shape of the rail 212. The arrangement of motion kinematics 21 laterally and directly alongside a metacarpophalangeal joint 31, as in the case of the proximal interphalangeal joint 32 and distal interphalangeal joint 33, is not possible insofar as the metacarpophalangeal joint 31 of another finger is already located there. This portion of the motion kinematics 21 is formed by the combination of rail 212 and carriage 211 and extends on an orbit laterally with respect to the metacarpophalangeal joint 31.

In order to transmit the pivoting movement from the motion kinematics 21 to the patient's finger that is to be treated, the first pivoting lever 213 can advantageously be secured to the distal phalanx 331 with a second releasable securing and/or bearing means 27, and the carriage 211 can be secured on the metacarpophalangeal joint with a first releasable securing and/or bearing means 26. The releasable securing and/or bearing means 26 and 27 for securing and/or bearing the fingers, and the releasable securing means 12 and 13 for securing the support 1 on the forearm 4 and/or on the hand 3, can advantageously be used universally for different sizes of the body part that is to be secured.

For the intended flexion movement of the fingers, the carriage 211, the second pivoting lever 214 and the first pivoting lever 213 are advantageously in drive engagement with the motion drive 22, such that the carriage 211 and the two pivoting levers 213 and 214 can be actively pivoted in accordance with the natural flexion movement of the fingers. In order to transmit the pivoting movement from the motion drive 22 to the carriage 211, the motion drive 22 is connected to the carriage 211. In a first embodiment, the motion drive 22 can preferably be configured as a spindle drive, of which the spindle is advantageously operatively connected to the carriage 211 of the finger motion rail 2.

In order to transmit the pivoting movement from the motion drive 22 to the two pivoting levers 213 and 214, at least one lever mechanism 215, 216 is preferably provided according to the invention.

FIG. 2*a* moreover shows that, in particular to perform an actively assisted flexion and/or extension movement, preferably the second securing means 27 can comprise a sensor 28 for measuring the force acting on the respective finger and/or exerted on the finger motion rail 2 by the respective finger. For this purpose, six-axis force sensors are suitable, such as are disclosed in DE 100 32 363 A1.

Figure 3:
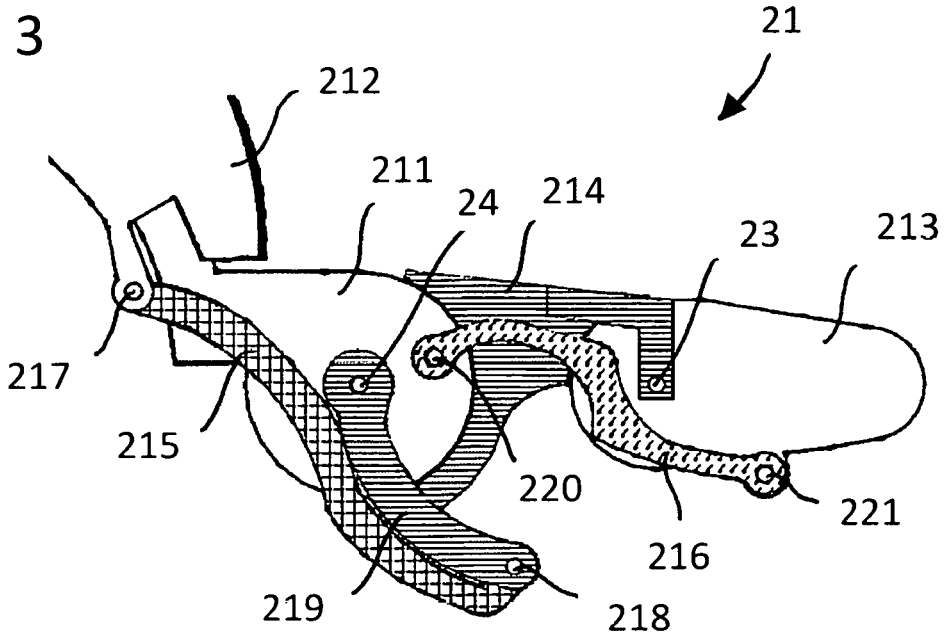
FIG. 3 shows a side view of a motion kinematic together with lever mechanism and joint connections in an extended state.
Figure 4:
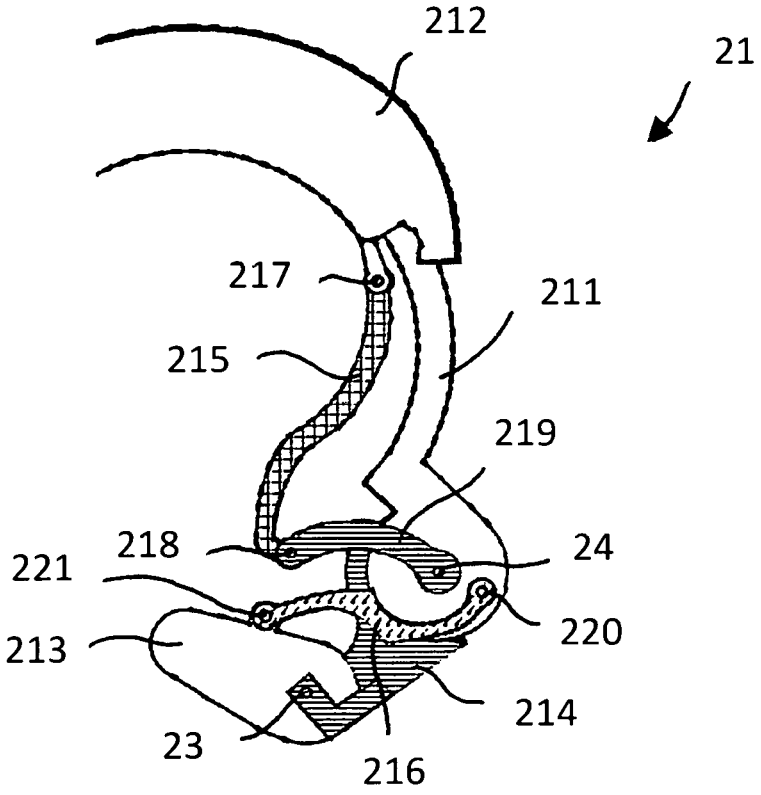
FIG. 4 shows the motion kinematic from FIG. 3 in a partially flexed state.

FIG. 3 and FIG. 4 each show a side view of a motion kinematic 21 together with lever mechanism 215, 216 and joint connections 217, 218, 220, 221 in an extended state (FIG. 3) and a partially flexed state (FIG. 4).

Figure 5A:
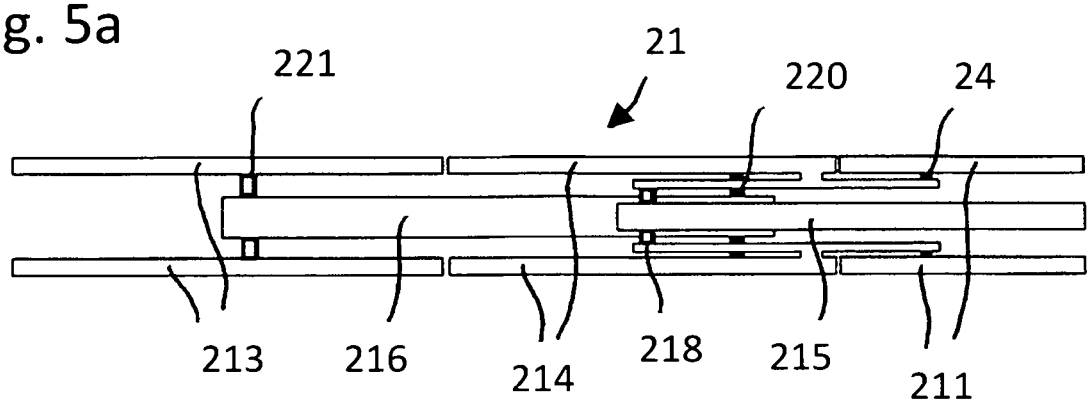
FIG. 5*a* shows a bottom view of a part of the motion kinematic from FIGS. 3 and 4.
Figure 5B:
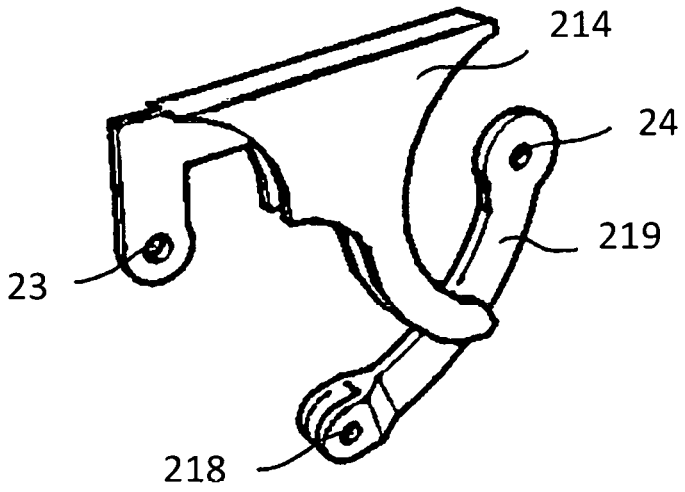
FIG. 5*b* shows a second pivoting lever together with connection means of the motion kinematic from FIG. 5*a;*
Figure 5C:
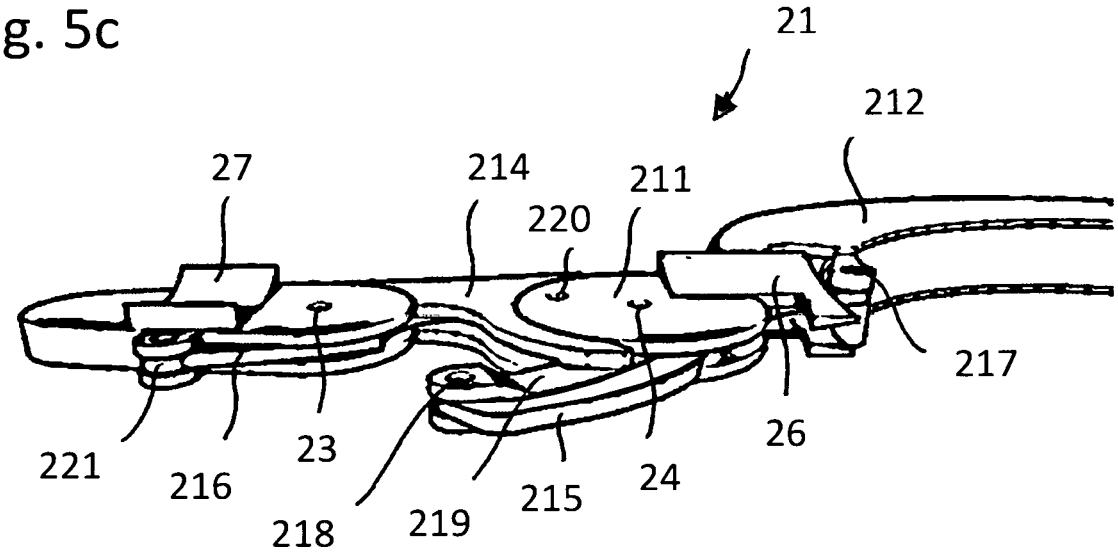
FIG. 5*c* shows a perspective view of the underside of a preferred motion kinematic according to the invention.

The lever mechanism 215, 216 is preferably accommodated at least partially inside the outer contour of the pivoting lever (cf. FIGS. 5*a* and 5*c*). The lever mechanism 215, 216 and the pivoting levers 213, 214 are adapted by their structure to the force that is needed to move the respective finger that is to be treated. This means that, at a constant uptake of force from the motion drive 22, the motion kinematic 21 makes available different forces for the motion therapy. A more or less extended finger requires little force in order to be flexed, whereas a considerably flexed finger requires much more force in order to be further flexed. The motion kinematic 21 is adapted approximately to these differences. With a finger more or less extended, a lower force is exerted on the finger than in the case of a more or less flexed finger.

To illustrate this, FIGS. 5*a* to 5*c* show parts of the motion kinematics 21 of a finger motion rail 2 from different viewing angles and in an enlarged representation.

FIG. 5*a* shows a bottom view of a part of the motion kinematics 21 from FIGS. 3 and 4. It reveals in particular the interaction of the first pivoting lever 213 and second pivoting lever 214, and also of the carriage 211 with the first lever mechanism 215 and the second lever mechanism 216.

For the intended flexion movement of the fingers, the carriage 211, the second pivoting lever 214 and the first pivoting lever 213 can advantageously be in drive engagement with the motion drive 22, such that the two pivoting levers 213 and 214 are actively pivoted via the carriage 211 in accordance with the natural flexion movement of the fingers. In order to transmit the pivoting movement from the motion drive 22 to the carriage 211, the motion drive 22 is connected to the carriage 211. In order to transmit the pivoting movement from the motion drive 22 to the two pivoting levers 213 and 214, at least one lever mechanism is provided, preferably two lever mechanisms 215, 216 are provided.

A first lever mechanism 215 can advantageously be pivotably connected to the rail 212 via a joint connection 217 and to the second pivoting lever 214 via a second joint connection 218, in particular via a connection 219.

FIG. 5*b* shows an enlarged representation of a second pivoting lever 214 and connection means 219 from FIG. 5*a*. As can be seen here, the second pivoting lever 214 and the connection means 219 can be formed in one piece. Alternatively to this, the second pivoting lever 214 and the connection means 219 can also be two separate components and in particular can be rigidly connected to each other, for example welded to each other.

The arrangement of the joint connections 217 and 218 is preferably configured in such a way that, in the motorized driving of the carriage 211 by the motion drive 22, the second pivoting lever 214 can also be motor-driven by the motion drive 22 via the lever mechanism 215. A second lever mechanism 216 can furthermore be pivotably connected to the carriage 211 via a first joint connection 220 and to the first pivoting lever 213 via a second joint connection 221. The arrangement of the joint connections 220 and 221 is preferably configured in such a way that, in the motorized driving of the carriage 211 by the motion drive 22, the first pivoting lever 213 can also be motor-driven by the motion drive 22 via the lever mechanism 216.

FIG. 5*c* is a perspective bottom view illustrating the interaction of the motion kinematics 21 of a preferred finger motion rail 2 according to the invention. Here, the first lever mechanism 215 and the second lever mechanism 216 are advantageously accommodated at least partially inside the outer contour of the first pivoting lever 213 and second pivoting lever 214.

Figure 6A:
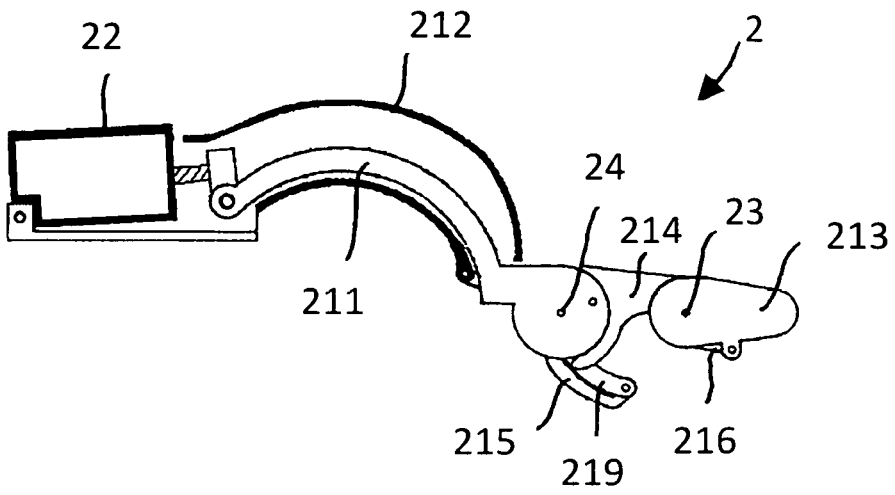
FIG. 6*a* shows a side view of an embodiment of a finger motion rail with motion kinematic and motion drive, wherein the motion drive is configured as a spindle drive.
Figure 6B:
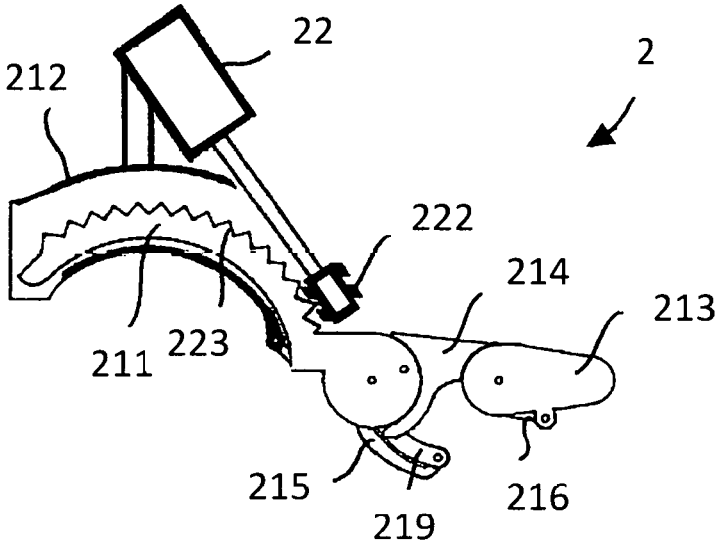
FIG. 6*b* shows a second embodiment of the finger motion rail from FIG. 6*a*, wherein the motion drive is configured as a worm drive arranged on the rail and having a correspondingly shaped carriage, which worm drive engages in a toothing formed on the carriage.
Figure 6C:
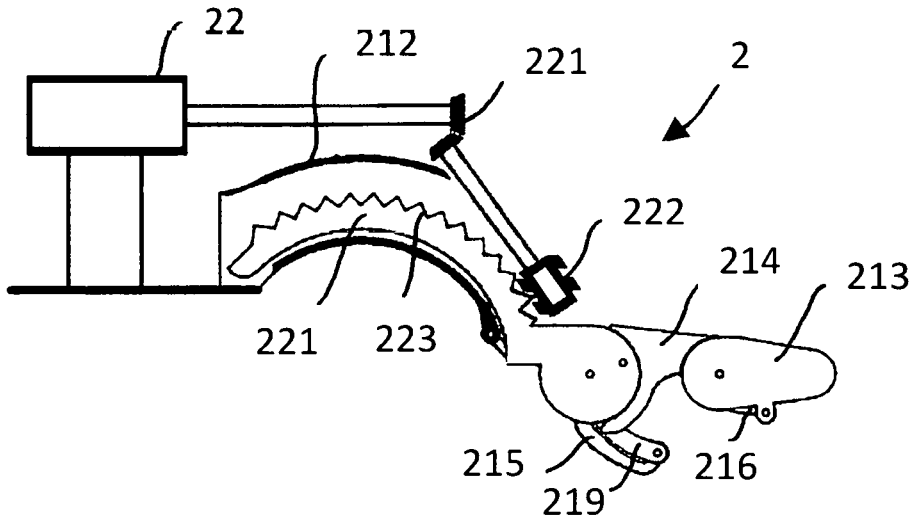
FIG. 6*c* shows a further alternative embodiment of a finger motion rail in which the motion drive is configured as a worm drive arranged on the upper shell and having a correspondingly shaped carriage, which worm drive engages in a toothing formed on the carriage.

FIGS. 6*a* to 6*c* are side views showing alternative embodiments of a finger motion rail 2 according to the invention with motion kinematics 21 and motion drive 22. It will be seen from FIG. 6*a* that the motion drive 22 is itself advantageously of a pivotable design or can be arranged pivotably on the upper shell 10. If the motion drive 22 is configured as a spindle drive as in the example shown here, then a pivotability or a pivotable arrangement of the motion drive 22 on the upper shell 10 can advantageously tolerate a movement of the spindle, advantageously operatively connected to the carriage 211 for force transmission, particularly if the connection point of spindle and carriage 211 has to follow the shape of the rail 212 and/or the shape of the carriage 211 during the operation of the therapy device. As an alternative to this, as shown in FIG. 6*b* and FIG. 6*c*, the motion drive 22 can also be configured as a worm drive which drives the carriage 211 by engagement of its worm head 222 in a toothing 223 formed on the carriage 211. The motion drive 22 can be arranged on the rail 212, as can be seen in FIG. 6*b*, or, as is shown in FIG. 6*c*, it can be arranged on the upper shell 10 of the support 1. In the latter case, it can be advantageous if the drive shaft of the motion drive 22 has bevel gears 221 for transmitting force to the carriage 211.

Figure 7:
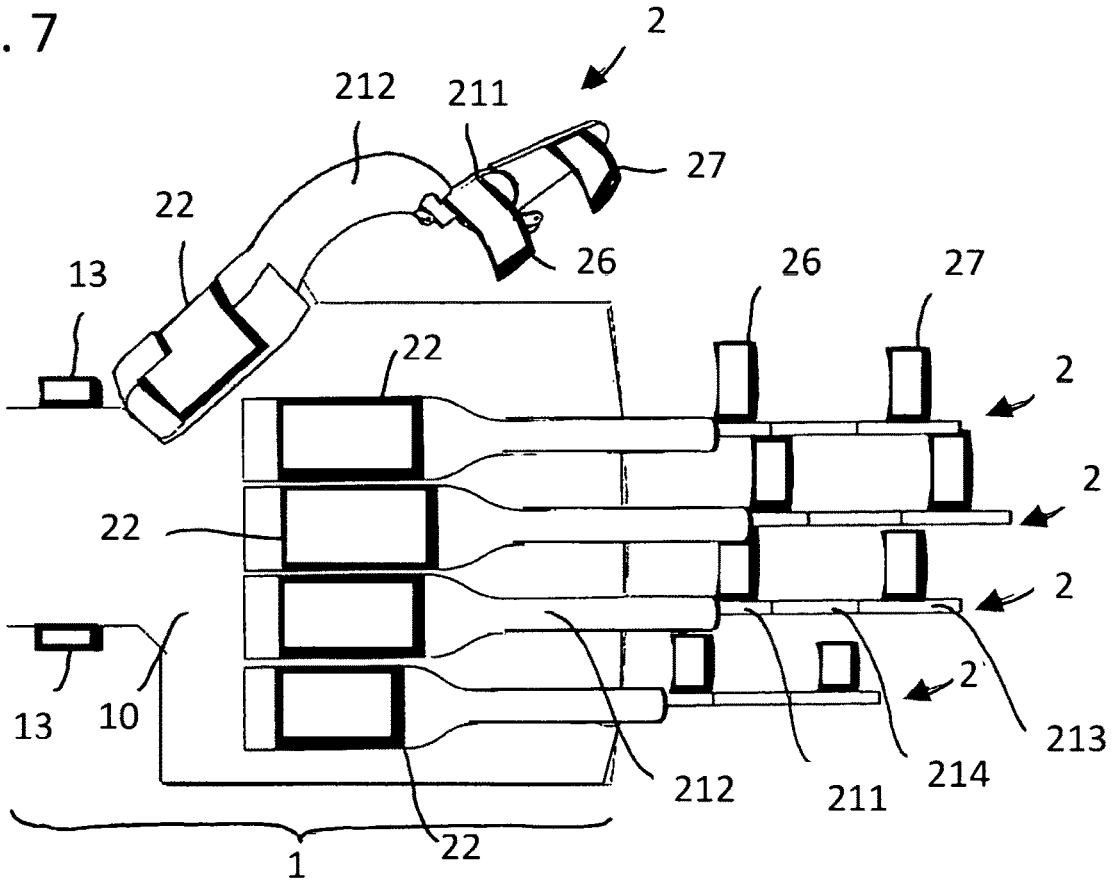
FIG. 7 shows a therapy device comprising a support and five finger motion rails, wherein the finger motion rails for index finger, middle finger, ring finger and little finger are arranged relatively close to one another on the support and at the same height with respect to the hand/forearm axis.
Figure 8:
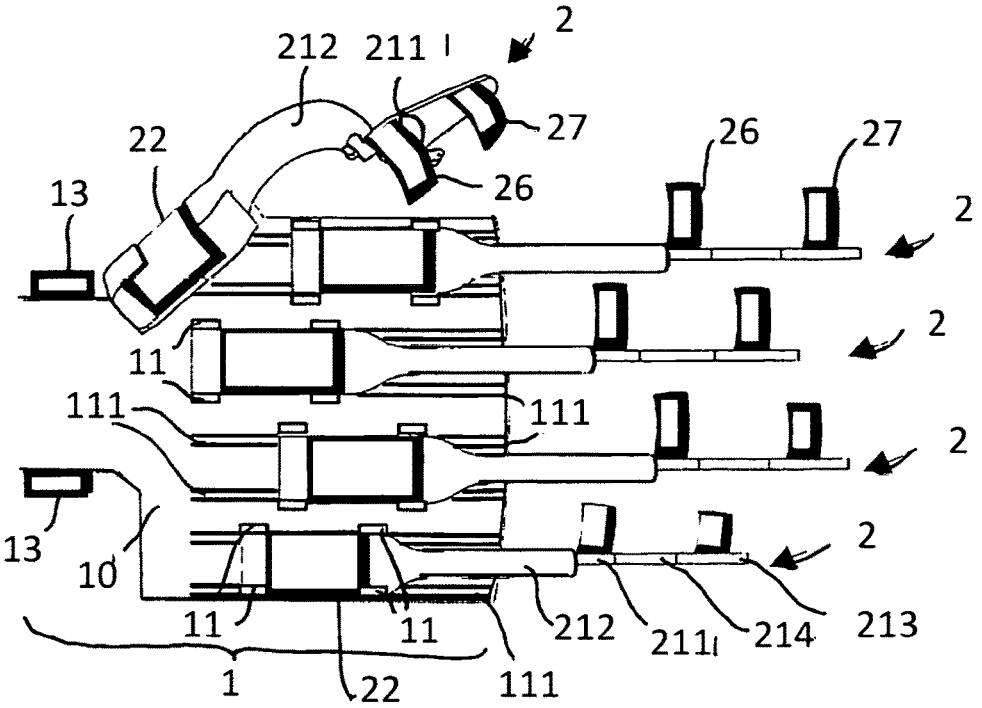
FIG. 8 shows the therapy device from FIG. 7, wherein the finger motion rails for index finger, middle finger, ring finger and little finger are arranged relatively far apart from one another on the support and at a different height with respect to the hand/forearm axis.

FIG. 7 and FIG. 8 finally show alternative embodiments of a preferred therapy device according to the invention comprising a support 1 and five finger motion rails 2.

FIG. 7 shows an embodiment in which the finger motion rails 2 for index finger, middle finger, ring finger and little finger are arranged relatively close to one another on the support 1 and at the same height with respect to the "hand 3/forearm 4" axis. Here, the finger motion rails 2 for passive and/or actively assisted motion of the respective finger are advantageously arranged adjustably and lockably on the upper shell 10, in particular magnetically or by a hook-and-loop fastener.

As an alternative or addition to the above, FIG. 8 shows an adjustable and lockable securing of the finger motion rails 2 on the upper shell 10 by means of rails 111 and clamping holders 11. This can advantageously permit an individual adjustment to fingers of different lengths. The spacing of the finger motion rails 2 from one another is wider in this example, as may be expedient for a comparatively wider finger spacing and/or for a comparatively broader hand 3.

The present invention makes available a finger motion rail 2, having dedicated motion kinematics 21 for each selected finger, which is for the first time arranged laterally of the finger that is to be treated. A therapy device is thus created which is able to perform the movements in a manner adapted to each finger and thus more ergonomically and more effectively. Therefore, a great improvement is achieved over the prior art, in which the motion kinematics can still only be adapted inadequately to the different shapes of the fingers.

LIST OF REFERENCE SIGNS

1 support
10 upper shell
11 clamping holder for fixing the finger motion rail 2
  111 rail
12 first securing means for fixing the upper shell 10 on the hand 3
13 second securing means for fixing the upper shell 10 on the forearm 4
14 control system
2 finger motion rail
21 motion kinematic
  211 carriage
  212 rail
  213 first pivoting lever
  214 second pivoting lever
  215 first lever mechanism
  216 second lever mechanism
  217 first joint connection of the first lever mechanism 215
  218 second joint connection of the first lever mechanism 215
  219 connection means
  220 first joint connection of the second lever mechanism 216
  221 second joint connection of the second lever mechanism 216
22 motion drive
  221 bevel gear
  222 worm head
  223 toothing
23 first pivot axis between first pivoting lever 213 and second pivoting lever 214
24 second pivot axis between second pivoting lever 214 and carriage 211
25 center point of the orbit
26 first securing and/or bearing means for securing to the carriage 211
27 second securing and/or bearing means for securing to the first pivoting lever 213
28 sensor
3 hand
30 wrist
31 metacarpophalangeal joint
  311 proximal phalanx
32 proximal interphalangeal joint
  321 middle phalanx
33 distal interphalangeal joint
  331 distal phalanx
4 forearm

The invention claimed is:

1. A therapy device for performing a sustained, passive and/or actively assisted motion of fingers or a thumb of a hand of a patient, the therapy device comprising:
a support having an upper shell and a control system;
at least one finger motion rail having a kinematic motion mechanism for a finger or the thumb and being connected to said upper shell, said kinematic motion mechanism having a motion drive being in control engagement with said control system;
said kinematic motion mechanism having a rail, a carriage that moves in said rail and configured for being disposed around a metacarpophalangeal joint and at least one pivoting lever, said kinematic motion mechanism having at least one lever mechanism, said at least one pivoting lever configured for being disposed laterally alongside a finger or the thumb for the passive and/or actively assisted motion of the finger or the thumb;
said motion drive providing motorized driving of said carriage, and
said motion drive providing motorized driving of said at least one pivoting lever via said at least one lever mechanism; and
said at least one finger motion rail disposed adjustably and lockably on said upper shell for the passive and/or actively assisted motion of a respective finger.

2. The therapy device according to claim 1, wherein said at least one pivoting lever includes:
a first pivoting lever for securing a distal phalanx; and
a second pivoting lever, said first pivoting lever is pivotably connected to said second pivoting lever, and said second pivoting lever is pivotably connected to said carriage.

3. The therapy device according to claim 2, wherein said carriage moves on an orbit which is defined by a shape of said carriage and/or of said rail.

4. The therapy device according to claim 2, wherein:
said kinematic motion mechanism has a connection means; and
said lever mechanism has at least two joint connections which pivotably connect said lever mechanism to said carriage, said rail, said first pivoting lever, said second pivoting lever or said connection means.

5. The therapy device according to claim 4, wherein a configuration of said joint connections is constructed that, during a movement of said carriage, a force transmission to said first pivoting lever, to said second pivoting lever and/or to said connection means takes place.

6. The therapy device according to claim 2, further comprising:
a first releasable securing and/or bearing means for releasably securing and/or bearing a proximal phalanx of the finger to be treated are arranged on said carriage; and/or
a second releasable securing and/or bearing means for releasably securing and/or bearing a distal phalanx of the finger to be treated are disposed on said first pivoting lever.

7. The therapy device according to claim 6, wherein at least one mechanical component of said kinematic motion mechanism and/or one of said first and second releasable securing and/or bearing means have at least one sensor for measuring a force acting on the finger and/or exerted by the finger on the finger motion rail.

8. The therapy device according to claim 7, wherein said sensor exchanges control data with the control system and/or with said motion drive.

9. The therapy device according to claim 6, wherein said first pivoting lever and/or said second releasable securing and/or bearing means have at least one sensor for measuring a force acting on the finger and/or exerted by the finger on the finger motion rail.

10. The therapy device according to claim 2, wherein said motion drive provides the motorized driving of at least one of said first or said second pivoting levers via said at least one lever mechanism indirectly by connection to said carriage.

11. The therapy device according to claim 1, further comprising a releasable clamping holder, the finger motion rails can each be fixed on said upper shell, by said releasable clamping holder, such that the finger motion rails can be adjusted in terms of a position with respect to said upper shell when said clamping holder is opened.

12. The therapy device according to claim 1, further comprising first and second releasable securing means, on a basis of said first and second releasable securing means, said upper shell is configured to be fixable on a hand rest or is configured to be fixable on an actual patient; and wherein said upper shell is configured to be fixable on a basis of said first releasable securing means on the hand of the patient and/or on a basis of said second releasable securing means on a forearm of the patient.

13. The therapy device according to claim 1, wherein said control system is mounted on said upper shell of said support.

14. The therapy device according to claim 1, wherein one or more of said at least one finger motion rail is adjustable and lockable parallel and/or perpendicular to an axis running from an elbow to a wrist of a patient.

15. The therapy device according to claim 1, wherein one or more of said at least one finger motion rail is attached to said upper shell by magnets or hook-and-loop fasteners.

16. The therapy device according to claim 1, further comprising mounting rails on said upper shell for mounting respective clamping holders.

* * * * *